US006354804B1

(12) United States Patent
Leung

(10) Patent No.: US 6,354,804 B1
(45) Date of Patent: Mar. 12, 2002

(54) FLUID DISPLACING BLADE

(76) Inventor: Chi Keung Leung, Unit 3, 339 Rokeby Road, Subiaco, Western Australia (AU)

( * ) Notice: Subject to any disclaimer, the term of this patent is extended or adjusted under 35 U.S.C. 154(b) by 0 days.

(21) Appl. No.: 09/402,478

(22) PCT Filed: Apr. 8, 1998

(86) PCT No.: PCT/AU98/00239

§ 371 Date: Oct. 13, 1999

§ 102(e) Date: Oct. 13, 1999

(87) PCT Pub. No.: WO98/46482

PCT Pub. Date: Oct. 22, 1998

(30) Foreign Application Priority Data

Apr. 14, 1997 (AU) ..... P06201

(51) Int. Cl.[7] ..... B63H 1/26
(52) U.S. Cl. ..... 416/231 R
(58) Field of Search ..... 416/231 R

(56) References Cited

U.S. PATENT DOCUMENTS

| | | | | | |
|---|---|---|---|---|---|
| 218,438 | A | * | 8/1879 | Heath | 416/231 R |
| 241,124 | A | * | 5/1881 | Deane | 416/231 R |
| 900,797 | A | * | 10/1908 | Taylor | 416/231 R X |
| 1,066,988 | A | * | 7/1913 | Boutwell | 416/231 R |
| 1,097,991 | A | * | 5/1914 | Sawyer | 416/90 R |
| 1,717,745 | A | * | 6/1929 | Tismer | 416/231 R X |
| 4,188,906 | A | | 2/1980 | Tachmindji | |
| 4,714,408 | A | * | 12/1987 | Abe | 416/231 R X |
| 5,244,349 | A | * | 9/1993 | Wang | 416/231 R |

FOREIGN PATENT DOCUMENTS

| | | | |
|---|---|---|---|
| AU | 25138/71 | A | 8/1972 |
| AU | 25310/92 | B | 1/1993 |
| AU | 26211/92 | A | 8/1993 |
| CA | 1213789 | A | 11/1986 |
| DE | 3242-589 | A | 5/1983 |
| DE | 4425870 | A | 12/1994 |
| GB | 2163218 | A | 2/1986 |
| SE | 9004030 | A | 12/1990 |

* cited by examiner

*Primary Examiner*—John E. Ryznic
(74) *Attorney, Agent, or Firm*—Miles & Stockbridge; John C. Kerins

(57) ABSTRACT

A propeller with five blades is supported from a hub. A series of apertures is distributed relatively evenly across faces of the blades, the apertures extending from one face of a blade to an opposite face of the blade. The axial extent of the apertures is substantially aligned with the direction of movement of the blades relative to the axis of the propeller. The apertures are normal both to the radial extent of the propeller and the axial extent of the propeller. Each aperture includes a beveled edge in the form of a countersunk lip extending around the periphery on the face. The flow of fluid through the apertures is believed to interfere with turbulent flow such that propeller efficiency is improved.

26 Claims, 3 Drawing Sheets

FLUID DISPLACING BLADE

FIELD OF THE INVENTION

The present invention relates to the fields of blades acting on fluids, particularly for propulsion of craft, but possibly also for blades acting on fluids in pumps.

Particularly the invention relates to blades acting on water for the propulsion of water craft; in rotodynamic machines such as propellers on in-board, outboard, or stern drive units on boats such as pleasure craft, screws on larger boats and ships, impellors in jet drive units. It is also possible that the invention may have application in propellers for displacing air, such as in aeroplanes, hovercraft, and rotors in helicopters.

In addition, the invention might have application impellers in pumps, and turbines and the like.

BACKGROUND OF THE INVENTION

A difficulty with propellers in water craft is that as the speed of the propeller increases, there is a loss of efficiency. Much of this loss is induced by the rotary motion of the blades of the propeller imparting a rotary motion in the water, and also giving rise to turbulence, eddies in flow and slippage. As the speed further increases, an even more catastrophic effect known as cavitation can be observed.

The invention seeks to ameliorate the aforementioned problems.

Throughout the specification, unless the context requires otherwise, the word "comprise" or variations such as "comprises" or "comprising", will be understood to imply the inclusion of a stated integer or group of integers but not the exclusion of any other integer or group of integers.

SUMMARY OF THE INVENTION

In accordance with one aspect of the invention there is provided in a blade in a rotodynamic machine for acting on a fluid, the blade having two surfaces, one on either side thereof, at least one surface of which acts on said fluid; a plurality of apertures extending through said blade between said two surfaces in a direction substantially normal to the radial extent of said rotodynamic machine; said plurality of apertures located in positions spread substantially evenly throughout said blade.

Preferably said apertures have a cross-sectional area of up to 50% of the entire blade area.

Preferably said apertures have a cross-sectional area of up to 20% of the entire blade area.

Preferably said apertures have a cross-sectional area of up to 10% of the entire blade area.

Preferably said apertures have a cross-sectional area of up to 5% of the entire blade area.

Preferably said apertures have a cross-sectional area of between 1% and 3% of the entire blade area.

Preferably said apertures have a cross-sectional area of about 2% of the entire blade area.

Preferably the apertures have a diametric aspect ratio of up to 1:4. The apertures may be rectangular or elliptical, with such a diametric aspect ratio.

Preferably the apertures have a diametric aspect ratio of up to 1:2.

Preferably the apertures are circular in cross-section (diametric aspect ratio of 1:1).

Preferably the apertures include a bevelled leading edge on the front of the blade.

The size of the apertures is dependent upon factors such as the speed of the blade through the fluid. In this regard, an aperture size of 2.5 to 3.5 mm would be appropriate where the blade is a blade in a propeller for use on a power boat. Faster rotational speeds or a finer pitch may require larger apertures. In addition, where the blade is a blade in a propeller, where there is a finer pitch or faster rotational speeds are employed, the apertures may comprise a larger cross sectional area of the blade.

In the case of a propeller it is preferred that the size of the apertures at the outer edge (where the linear speed is faster) is larger than the size of the apertures nearer the hub. It is preferred that the size of the apertures vary progressively or in stepwise manner, decreasing from the outer edge of the propeller toward the hub. For a propeller in power boat or on an outboard motor, the size of the aperture near the outer edge of the blade may be in the order of 2.8 mm to 3.0 mm, while the size of the apertures closest to the hub may be around 2.0 mm to 2.2 mm. The size of the apertures from the outer edge of the blade, toward those located closest to the hub, progressively decreases. It is most preferred that the size of the apertures between the outer edge of the blade and toward the hub is selected so that the flow rate of water flowing through each aperture is substantially constant, across the blade, so that the effect imparted is even across the entire propeller.

Preferably said plurality of apertures are aligned with their axial extent extending up to 30° from the direction of travel of the blade relative to the axis of the propeller.

Preferably said plurality of apertures are aligned with their axial extent extending up to 20° from the direction of travel of the blade relative to the axis of the propeller.

Preferably said plurality of apertures are aligned with their axial extent extending up to 10° from the direction of travel of the blade relative to the axis of the propeller.

Preferably said plurality of apertures are aligned with their axial extent extending up to 5° from the direction of travel of the blade relative to the axis of the propeller.

Preferably said plurality of apertures are aligned with their axial extent extending substantially in the direction of travel of the blade relative to the axis of the propeller.

The angle referred to above is the angle relative to the direction of rotational travel relative to the axis of the propeller, and not including any component derived from propulsion imparted by the blade. In the case of finer pitched blades, it will be necessary to have an angle of the aperture greater than about 20°. The finer the pitch of a propeller, the greater the angle of inclination of the apertures.

In accordance with a second aspect of the invention there is provided a rotodynamic machine having at least one blade as hereinbefore described.

In order to balance the rotodynamic machine, it is preferred that there be two or more of said blades. In practice there will be a plurality of blades in a dynamically balanced configuration, usually comprising three or more blades.

It will be understood that the rotodynamic machine may be a propeller on an inboard, outboard, or stern drive unit for a boat such as a pleasure craft, a propeller or screw on a ship, or an impellor in a jet drive unit in a jet boat. Similarly, the rotodynamic machine may be an impellor in a pump, a turbine in a hydro-electric power generation plant. It will also be understood that the rotodynamic machine may be a propeller employed on an aircraft or a rotor on a helicopter.

BRIEF DESCRIPTION OF THE DRAWINGS

The invention will now be described in the following description of one specific embodiment thereof, made with reference to the drawings, in which.

DESCRIPTION OF THE EMBODIMENT

Figure 1:
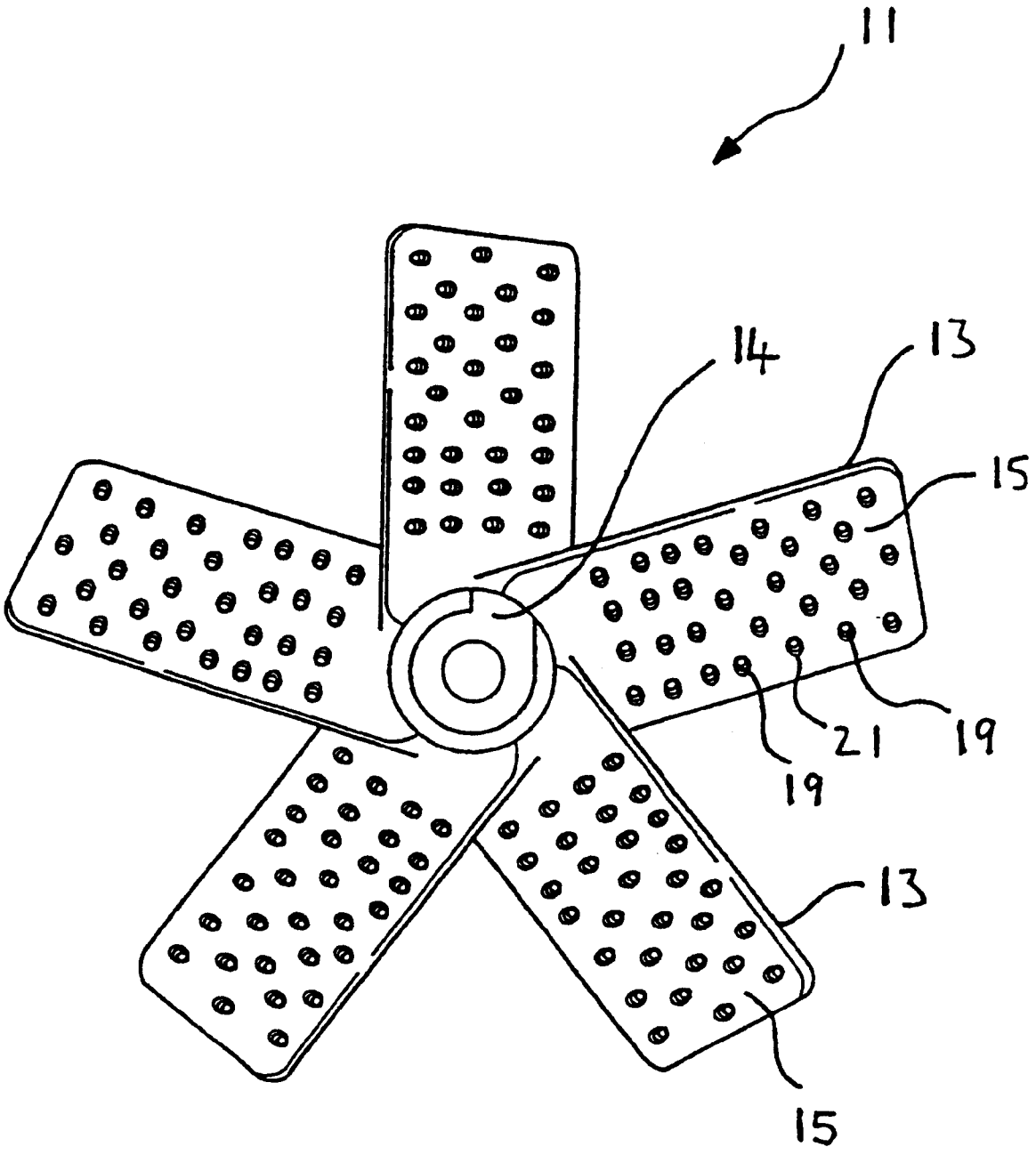
FIG. 1 is a view along the rotational axis of a propeller according to the embodiment, the propeller being for an outboard motor for a boat.
Figure 2:
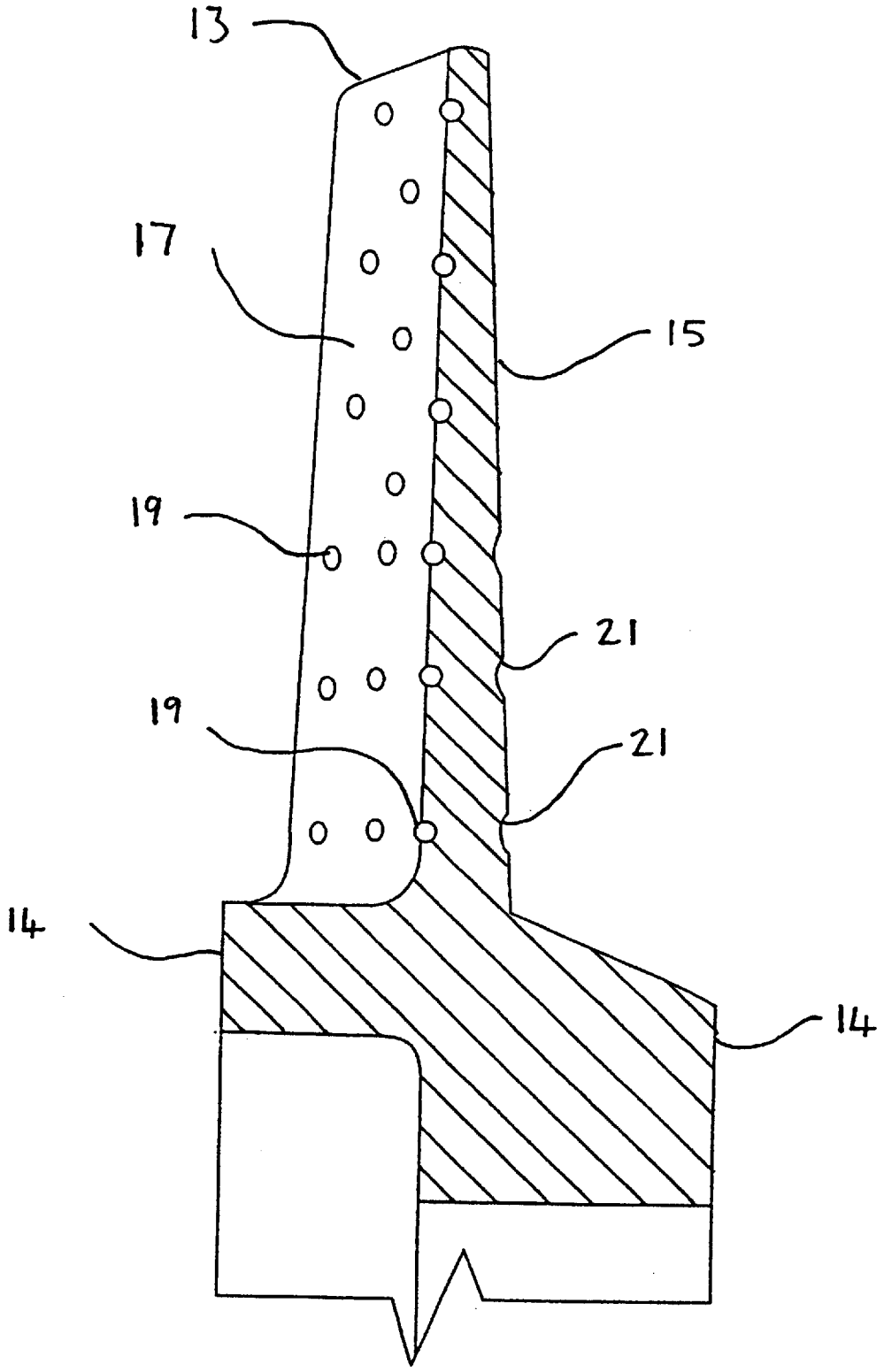
FIG. 2 is a radial cross-sectional view of the propeller of FIG. 1, showing one blade thereof.
Figure 3:
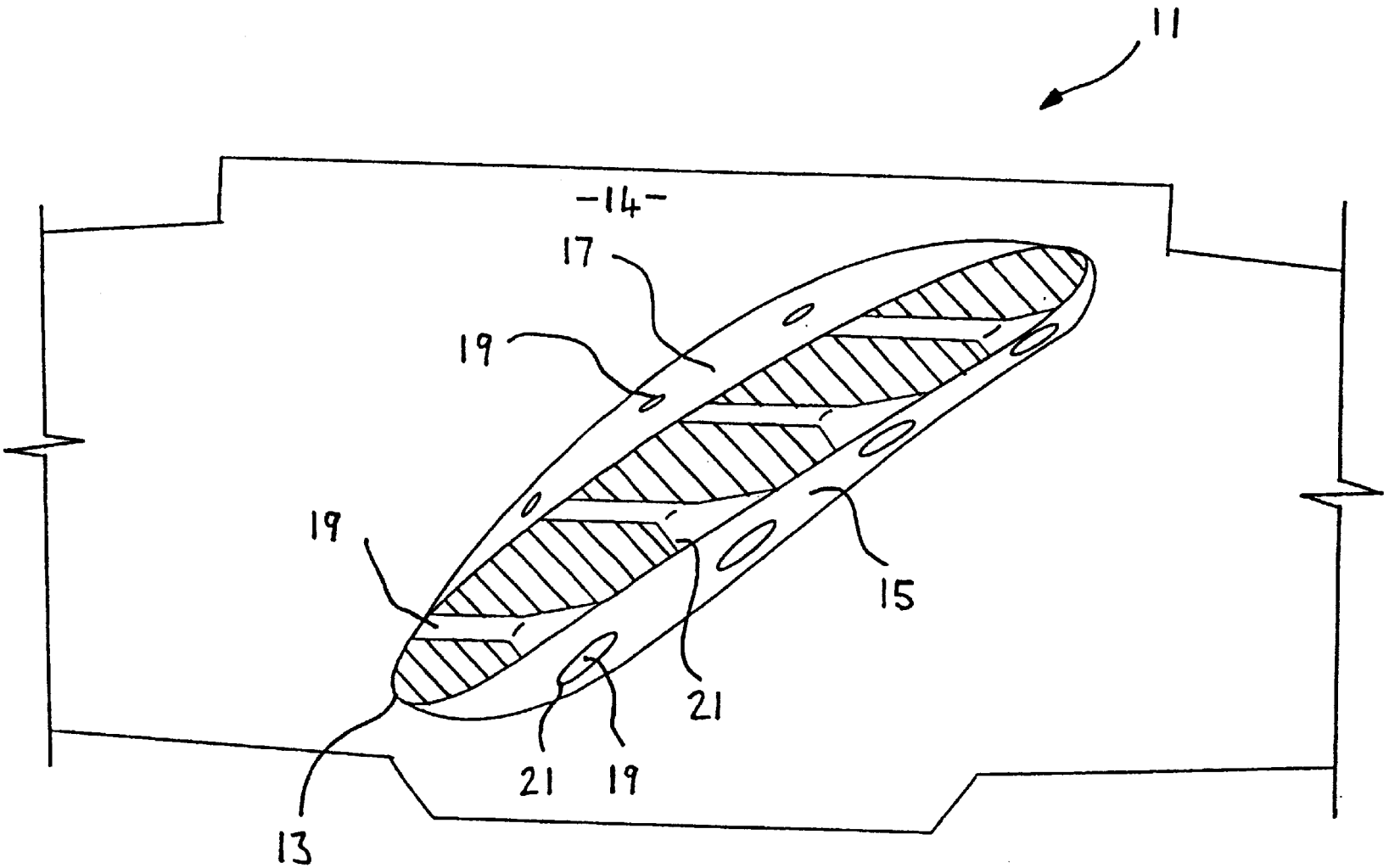
FIG. 3 is a lateral cross-sectional view through one of the blades of FIG. 1.

Referring to FIG. 1, a rotodynamic machine in the form of a propeller 11 is shown. The propeller has five blades 13 supported from a hub 14, and is shown with the faces 15 of those blades 13 facing the viewer (out of the page). The propeller 11, being a right hand propeller, produces thrust to propel a boat forward, when rotating clockwise. The area of each face 15 is in the order of 4000 $mm^2$, with the blade having a length of 80 mm and a width of 50 mm.

Extending through each blade 13, from the face 15 to the back 17 are thirty one apertures 19. Those apertures located near the outer edge of the propeller have a diameter of 2.8 mm, while those apertures located near the hub have a diameter of 2.2 mm. Those apertures located in a central band approximately 28 mm to 50 mm from the outer edge of the propeller are of 2.5 mm diameter. The axial extent of the apertures 19 is substantially aligned with the direction of movement of the blades 13 relative to the axis of the propeller 11. For simplicity of construction, the apertures 19 are linear, although in an alternative embodiment the apertures could be arcuate, to line up with the angular direction of movement of the propeller. The apertures 19 are normal both to the radial extent of the propeller 11 and the axial extent of the propeller.

Each aperture 19 includes a bevelled edge in the form of a countersunk lip 21 extending around the periphery, on the face 15. The countersunk lip 21 can be formed when de-swarfing the apertures 19 with a de-burring tool, and is believed to assist in flow of fluid across the face (and through the apertures 19), although in an alternative embodiment, the lip could be omitted.

The propeller of the embodiment is intended for use on a two horsepower outboard motor fitted to a small aluminum dingy. The flow of water through the apertures 19 is believed to interfere with turbulent water adjacent to the back 17 of the propeller 11, and so lead to improved efficiency of the propeller.

In the case where the propeller was powered by a more powerful motor, the apertures are believed to allow fluid to flow to where a vacuum and air bubbles can form forward of the back of the propeller. This effect is known as cavitation, and it leads to slippage (or loss of traction), and also can cause corrosion on the surface of the blade.

In alternative embodiments and particularly where the propeller may be of a finer pitch, the apertures may extend toward the back of the blade in a forward direction at up to 45° to normal, or even 60° to 75° in extremely fine pitched propellers, the angle of the axial extent of the apertures being measured relative to the axial extent of the propeller, but while maintaining an axial extent substantially normal to the radial extent of the propeller.

It should be appreciated that the scope of the invention is not limited to the scope of the embodiment described herein.

What is claimed is:

1. In a blade in a rotodynamic machine for acting on a fluid, the blade having two surfaces, one on either side thereof, at least one surface of which acts on said fluid; a plurality of apertures extending through said blade between said two surfaces in a direction substantially normal to the radial extent of said rotodynamic machine, said plurality of apertures being located in positions spread substantially evenly throughout said blade.

2. A blade as claimed in claim 1 wherein said apertures have a cross-sectional area of up to 50% of the entire blade area.

3. A blade as claimed in claim 1 wherein said apertures have a cross-sectional area of up to 20% of the entire blade area.

4. A blade as claimed in claim 1 wherein said apertures have a cross-sectional area of up to 10% of the entire blade area.

5. A blade as claimed in claim 1 wherein said apertures have a cross-sectional area of up to 5% of the entire blade area.

6. A blade as claimed in claim 1 wherein said apertures have a cross-sectional area of between 1% and 3% of the entire blade area.

7. A blade as claimed in claim 1 wherein said apertures have a cross-sectional area of about 2% of the entire blade area.

8. A blade as claimed in claim 1 wherein said apertures are rectangular or elliptical.

9. A blade as claimed in claim 8 wherein said apertures have a diametric aspect ratio of up to 1:10.

10. A blade as claimed in claim 8 wherein said apertures have a diametric aspect ratio of up to 1:4.

11. A blade as claimed in claim 8 wherein said apertures have a diametric aspect ratio of up to 1:2.

12. A blade as claimed in claim 1 wherein said apertures are circular or square in cross-section.

13. A blade as claimed in claim 1 wherein the apertures include a bevelled leading edge on the face thereof.

14. A blade as claimed in claim 1 wherein said plurality of apertures are aligned with their axial extent extending up to 75° from the direction of travel of the blade through the fluid.

15. A blade as claimed in claim 14 wherein said plurality of apertures are aligned with their axial extent extending up to 60° from the direction of travel of the blade through the fluid.

16. A blade as claimed in claim 14 wherein said plurality of apertures are aligned with their axial extent extending up to 45° from the direction of travel of the blade through the fluid.

17. A blade as claimed in claim 14 wherein said plurality of apertures are aligned with their axial extent extending up to 30° from the direction of travel of the blade through the fluid.

18. A blade as claimed in claim 14 wherein said plurality of apertures are aligned with their axial extent extending up to 20° from the direction of travel of the blade through the fluid.

19. A blade as claimed in claim 14 wherein said plurality of apertures are aligned with their axial extent extending up to 10° from the direction of travel of the blade through the fluid.

20. A blade as claimed in claim 14 wherein said plurality of apertures are aligned with their axial extent extending up to 5° from the direction of travel of the blade through the fluid.

21. A blade as claimed in claim 14 wherein said plurality of apertures are aligned with their axial extent extending substantially in the direction of travel of the blade through the fluid.

22. A rotodynamic machine such as a propeller or impellor or the like having at least one blade as claimed in claim 1.

23. A rotodynamic machine as claimed in claim 22 wherein there are a plurality of blades in a dynamically balanced configuration.

24. A rotodynamic machine as claimed in claim 22 wherein the size of said apertures near the outer edge is larger than the size of said apertures nearer the hub.

25. A rotodynamic machine as claimed in claim 24 wherein the size of said apertures varies progressively or in stepwise manner, decreasing from the outer edge of the rotodynamic machine toward the hub.

26. A rotodynamic machine as claimed in claim 25 wherein the size of the apertures between the outer edge of the blade and toward the hub is determined so that the flow rate of fluid flowing through each aperture is substantially constant across the blade, so that the effect imparted is even across the entire rotodynamic machine.

* * * * *

UNITED STATES PATENT AND TRADEMARK OFFICE

CERTIFICATE OF CORRECTION

PATENT NO. : 6,354,804 B1
DATED : March 12, 2002
INVENTOR(S) : Leung

It is certified that error appears in the above-identified patent and that said Letters Patent is hereby corrected as shown below:

Column 3, line 65 through Column 6, line 9,
Are to be canceled, and are to be replaced by Claims 1-17, as follows:

1. A blade in a rotodynamic machine for acting on a fluid, the blade having two surfaces, one on either side thereof, at least one surface of which acts on said fluid; said blade having a plurality of apertures extending through said blade between said two surfaces in a direction substantially normal to the radial extent of said rotodynamic machine, and extending through said blade with their axial extent extending from normal to the axial extent of said rotodynamic machine to up to 30° from the direction of travel of the blade through the fluid, said plurality of apertures being located in positions spread substantially evenly throughout said blade.

2. A blade as claimed in claim 1 wherein said apertures have a cross-sectional area of up to 20% of the entire blade area.

3. A blade as claimed in claim 1 wherein said apertures have a cross-sectional area of up to 10% of the entire blade area.

4. A blade as claimed in claim 1 wherein said apertures have a cross-sectional area of up to 5% of the entire blade area.

5. A blade as claimed in claim 1 wherein said apertures have a cross-sectional area of between 1% and 3% of the entire blade area.

6. A blade as claimed in claim 1 wherein said apertures have a cross-sectional area of about 2% of the entire blade area.

7. A blade as claimed in claim 1 wherein said apertures are circular in cross-section.

8. A blade as claimed in claim 1 wherein the apertures include a bevelled leading edge on the face thereof.

9. A blade as claimed in claim 1 wherein said plurality of apertures are aligned with their axial extent extending up to 20° from the direction of travel of the blade through the fluid.

10. A blade as claimed in claim 1 wherein said plurality of apertures are aligned with their axial extent extending up to 10° from the direction of travel of the blade through the fluid.

UNITED STATES PATENT AND TRADEMARK OFFICE

CERTIFICATE OF CORRECTION

PATENT NO. : 6,354,804 B1
DATED : March 12, 2002
INVENTOR(S) : Leung

It is certified that error appears in the above-identified patent and that said Letters Patent is hereby corrected as shown below:

12. A blade as claimed in claim 1 wherein said plurality of apertures are aligned with their axial extent extending substantially in the direction of travel of the blade through the fluid.

13. A rotodynamic machine such as a propeller or impellor or the like having at least one blade as claimed in claim 1.

14. A rotodynamic machine as claimed in claim 13 wherein there are a plurality of blades in a dynamically balanced configuration.

15. A rotodynamic machine as claimed in claim 13 wherein the size of said apertures near the outer edge is larger than the size of said apertures nearer the hub.

16. A rotodynamic machine as claimed in claim 15 wherein the size of said apertures varies progressively or in stepwise manner, decreasing from the outer edge of the rotodynamic machine toward the hub.

17. A rotodynamic machine as claimed in claim 16 wherein the size of the apertures between the outer edge of the blade and toward the hub is determined so that the flow rate of fluid flowing thorugh each aperature is substantially constant across the blade, so that the effect imparted is even across the entire rotodynamic machine.

Signed and Sealed this

Twenty-fourth Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,354,804 B1
DATED : March 12, 2002
INVENTOR(S) : Leung

It is certified that error appears in the above-identified patent and that said Letters Patent is hereby corrected as shown below:

Column 3, line 65 through Column 6, line 9,
Are to be canceled, and are to be replaced by Claims 1-17, as follows:

1. A blade in a rotodynamic machine for acting on a fluid, the blade having two surfaces, one on either side thereof, at least one surface of which acts on said fluid; said blade having a plurality of apertures extending through said blade between said two surfaces in a direction substantially normal to the radial extent of said rotodynamic machine, and extending through said blade with their axial extent extending from normal to the axial extent of said rotodynamic machine to up to 30° from the direction of travel of the blade through the fluid, said plurality of apertures being located in positions spread substantially evenly throughout said blade.

2. A blade as claimed in claim 1 wherein said apertures have a cross-sectional area of up to 20% of the entire blade area.

3. A blade as claimed in claim 1 wherein said apertures have a cross-sectional area of up to 10% of the entire blade area.

4. A blade as claimed in claim 1 wherein said apertures have a cross-sectional area of up to 5% of the entire blade area.

5. A blade as claimed in claim 1 wherein said apertures have a cross-sectional area of between 1% and 3% of the entire blade area.

6. A blade as claimed in claim 1 wherein said apertures have a cross-sectional area of about 2% of the entire blade area.

7. A blade as claimed in claim 1 wherein said apertures are circular in cross-section.

8. A blade as claimed in claim 1 wherein the apertures include a bevelled leading edge on the face thereof.

9. A blade as claimed in claim 1 wherein said plurality of apertures are aligned with their axial extent extending up to 20° from the direction of travel of the blade through the fluid.

10. A blade as claimed in claim 1 wherein said plurality of apertures are aligned with their axial extent extending up to 10° from the direction of travel of the blade through the fluid.

UNITED STATES PATENT AND TRADEMARK OFFICE

CERTIFICATE OF CORRECTION

PATENT NO. : 6,354,804 B1
DATED : March 12, 2002
INVENTOR(S) : Leung

It is certified that error appears in the above-identified patent and that said Letters Patent is hereby corrected as shown below:

11. A blade as claimed in claim 1 wherein said plurality of apertures are aligned with their axial extent extending up to 5° from the direction of travel of the blade through the fluid.

12. A blade as claimed in claim 1 wherein said plurality of apertures are aligned with their axial extent extending substantially in the direction of travel of the blade through the fluid.

13. A rotodynamic machine such as a propeller or impellor or the like having at least one blade as claimed in claim 1.

14. A rotodynamic machine as claimed in claim 13 wherein there are a plurality of blades in a dynamically balanced configuration.

15. A rotodynamic machine as claimed in claim 13 wherein the size of said apertures near the outer edge is larger than the size of said apertures nearer the hub.

16. A rotodynamic machine as claimed in claim 15 wherein the size of said apertures varies progressively or in stepwise manner, decreasing from the outer edge of the rotodynamic machine toward the hub.

17. A rotodynamic machine as claimed in claim 16 wherein the size of the apertures between the outer edge of the blade and toward the hub is determined so that the flow rate of fluid flowing thorugh each aperature is substantially constant across the blade, so that the effect imparted is even across the entire rotodynamic machine.

---

This certificate supersedes Certificate of Correction issued December 24, 2002.

Signed and Sealed this

Thirty-first Day of August, 2004

JON W. DUDAS
*Director of the United States Patent and Trademark Office*